US008353307B2

(12) United States Patent
Blaszczak et al.

(10) Patent No.: US 8,353,307 B2
(45) Date of Patent: Jan. 15, 2013

(54) SWIVEL HOSE WAGON

(75) Inventors: Greg Blaszczak, Hummelstown, PA (US); Peter Arcati, Dillsburg, PA (US)

(73) Assignee: Ames True Temper, Inc., Camp Hill, PA (US)

( * ) Notice: Subject to any disclaimer, the term of this patent is extended or adjusted under 35 U.S.C. 154(b) by 986 days.

(21) Appl. No.: 12/264,954

(22) Filed: Nov. 5, 2008

(65) Prior Publication Data

US 2010/0108158 A1 May 6, 2010

(51) Int. Cl.
*B65H 75/34* (2006.01)

(52) U.S. Cl. ..... 137/355.27; 137/355.26; 137/580

(58) Field of Classification Search ..... 137/355.12, 137/355.16, 355.19, 355.2, 355.26, 355.27, 137/580; 242/403.1, 407; 285/275
See application file for complete search history.

(56) References Cited

U.S. PATENT DOCUMENTS 4,501,442 A * 2/1985 Partus ..... 285/190
4,676,267 A * 6/1987 Bloch ..... 137/355.27
4,700,737 A * 10/1987 Nelson ..... 137/355.27
5,052,432 A * 10/1991 Vonalt et al. ..... 137/355.16
5,179,972 A * 1/1993 Eley ..... 137/355.19
5,462,298 A * 10/1995 Bodine ..... 280/47.34
5,797,424 A * 8/1998 Tisbo et al. ..... 137/355.27
5,988,207 A * 11/1999 Kownacki et al. ..... 137/355.27
6,505,861 B2 * 1/2003 Butterfield et al. ..... 285/184
6,637,454 B1 * 10/2003 Eley ..... 137/355.26
D547,021 S 7/2007 Stein

* cited by examiner

*Primary Examiner* — Stephen M Hepperle
*Assistant Examiner* — Kevin Murphy
(74) *Attorney, Agent, or Firm* — Eckert Seamans Cherin & Mellott, LLC; David C. Jenkins

(57) ABSTRACT

A hose wagon wherein the hose wagon frame assembly is structured to rotatably support a hose reel so that the hose reel may rotate freely about a generally vertical axis and a generally horizontal axis. This is accomplished by providing a water supply assembly having two rotational interfaces; one allowing rotation about a vertical axis, the other allowing rotation about a horizontal axis. Further, the hose wagon is free of frame members that extend vertically into the possible path of travel of a hose disposed on the hose reel. The frame assembly includes a handle member that is structured to move between an upper, first position, wherein the handle is disposed on the upper side of the hose wagon, and a second position, wherein the handle is disposed at a location lower than the path of travel of the hose coming off the hose reel.

19 Claims, 10 Drawing Sheets

SWIVEL HOSE WAGON

BACKGROUND OF THE INVENTION

1. Field of the Invention

This invention relates to hose wagons and, more specifically to a hose wagon wherein the hose reel, about which a use hose is coiled, is free to rotate completely about a vertical axis.

2. Background Information

Hose wagons are structured to support and carry a length of hose, hereinafter the "use hose," which is typically coiled about a hose reel. The hose wagon includes a frame assembly that rotatably supports the hose reel. The hose reel is, typically, structured to rotate about a horizontal axis, but may be structured to rotate about a vertical axis. A horizontal axis is preferred as winding the hose is more easily accomplished. The hose wagon is further coupled to a supply hose structured to supply water from a water supply. A hose wagon water supply assembly couples the supply hose and the use hose. The water supply assembly includes a rotatable interface disposed between the supply side and the use side. Typically, at least a portion of the water supply assembly, including the rotatable interface, is disposed along the rotational axis of the hose reel. In this configuration, the user may coil the use hose about the hose reel for transport, and then uncoil the use hose for use.

However, when a user is using the use hose, the use hose may be moved about the hose wagon into a location that causes the use hose to bind or become crimped. That is, typically, the use hose is uncoiled, or fed, from the front side of the hose wagon. When a user moves the use hose to a lateral side, or to the back side, of the hose wagon, the hose will bind or become crimped on the hose wagon. Accordingly, attempts have been made to provide a hose reel with two axes of rotation; a horizontal axis, for coiling/uncoiling the hose about the reel, and a vertical axis, that allows the use hose to be freely moved about the hose wagon. See e.g., U.S. Design Pat. No. D547,021.

These attempts while functional in the abstract, were not functional in operation. That is, such designs failed to account for effect of the either, or both, of the supply hose and use hose. For example, a hose wagon such as, but not limited to, the hose wagon disclosed in U.S. Design Pat. No. D547,021 has a vertically extending handle that extends above the bottom of the hose reel. Thus, if a user were to uncoil a length of use hose out of the lateral side of the hose wagon and then attempt to move behind the hose wagon to the other lateral side of the hose wagon, the use hose would bind against the handle. Thus, a hose wagon in this configuration actually has a limited range of vertical rotation.

Further, the range of vertical rotation of such hose wagons is also limited by the supply hose. When the supply hose is simply coupled to the use hose using a water supply assembly having a single rotational interface, e.g. as shown in U.S. Design Pat. No. D547,021 an interface disposed along the hose reel axis of rotation, the hose reel may not rotate freely about the vertical axis. That is, without a water supply assembly having a vertical rotation interface, the supply hose will simply wrap around the hose reel and prevent the free rotation thereof.

SUMMARY OF THE INVENTION

The disclosed and claimed concept is for a hose wagon wherein the hose wagon frame assembly is structured to rotatably support a hose reel so that the hose reel may rotate freely about a generally vertical axis and a generally horizontal axis. This is accomplished by providing a water supply assembly having two rotational interfaces; one allowing rotation about a vertical axis, the other allowing rotation about a horizontal axis. Further, the hose wagon is free of frame members that extend vertically into the possible path of travel of a use hose. This further includes a handle member that is structured to move between an upper, first position, wherein the handle is disposed on the upper side of the hose wagon, and a second position, wherein the handle is disposed at a location lower than the path of travel of the hose coming off the hose reel.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
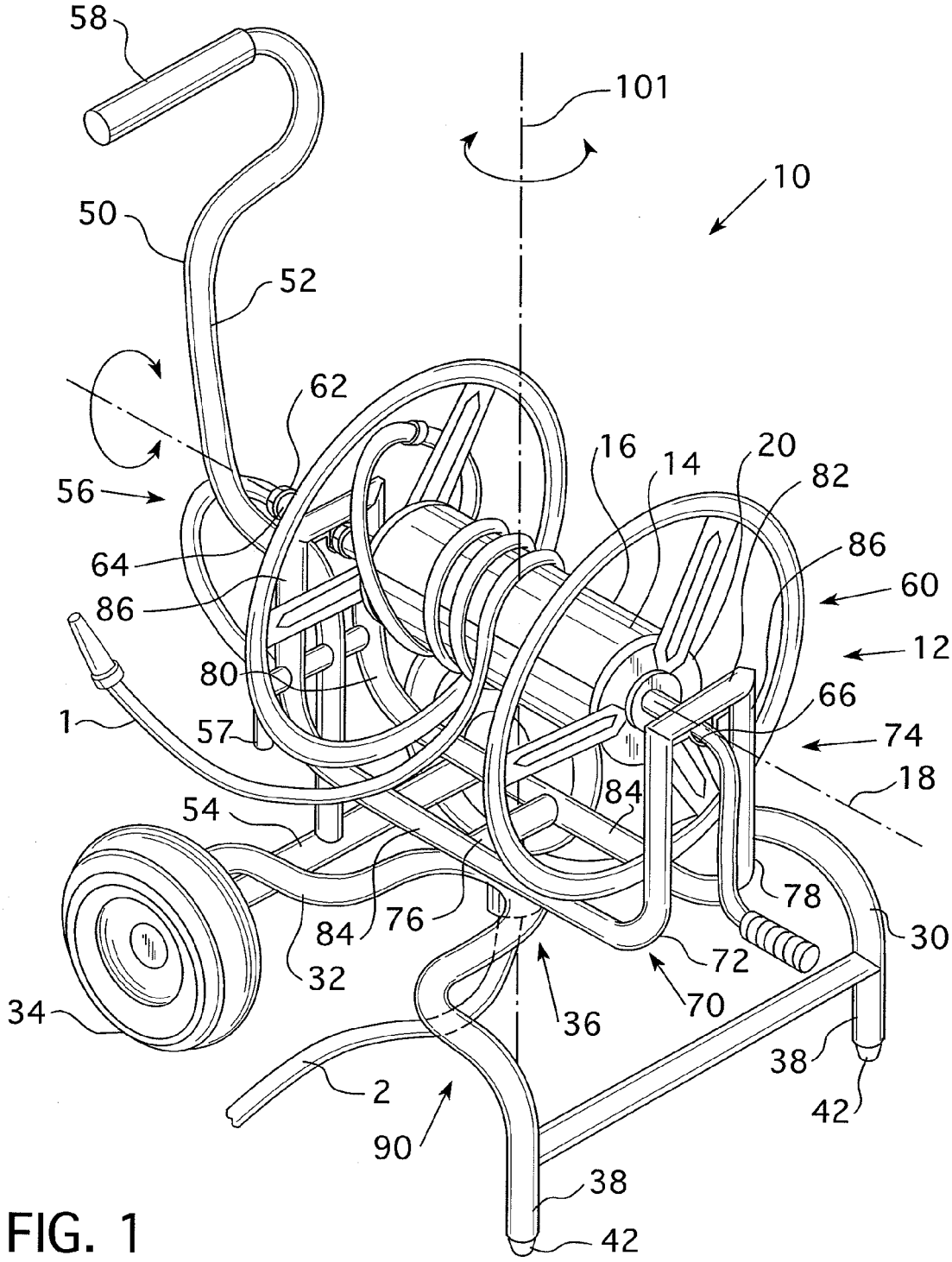
FIG. 1 is an isometric view of a hose wagon with the handle in the first position.
Figure 2:
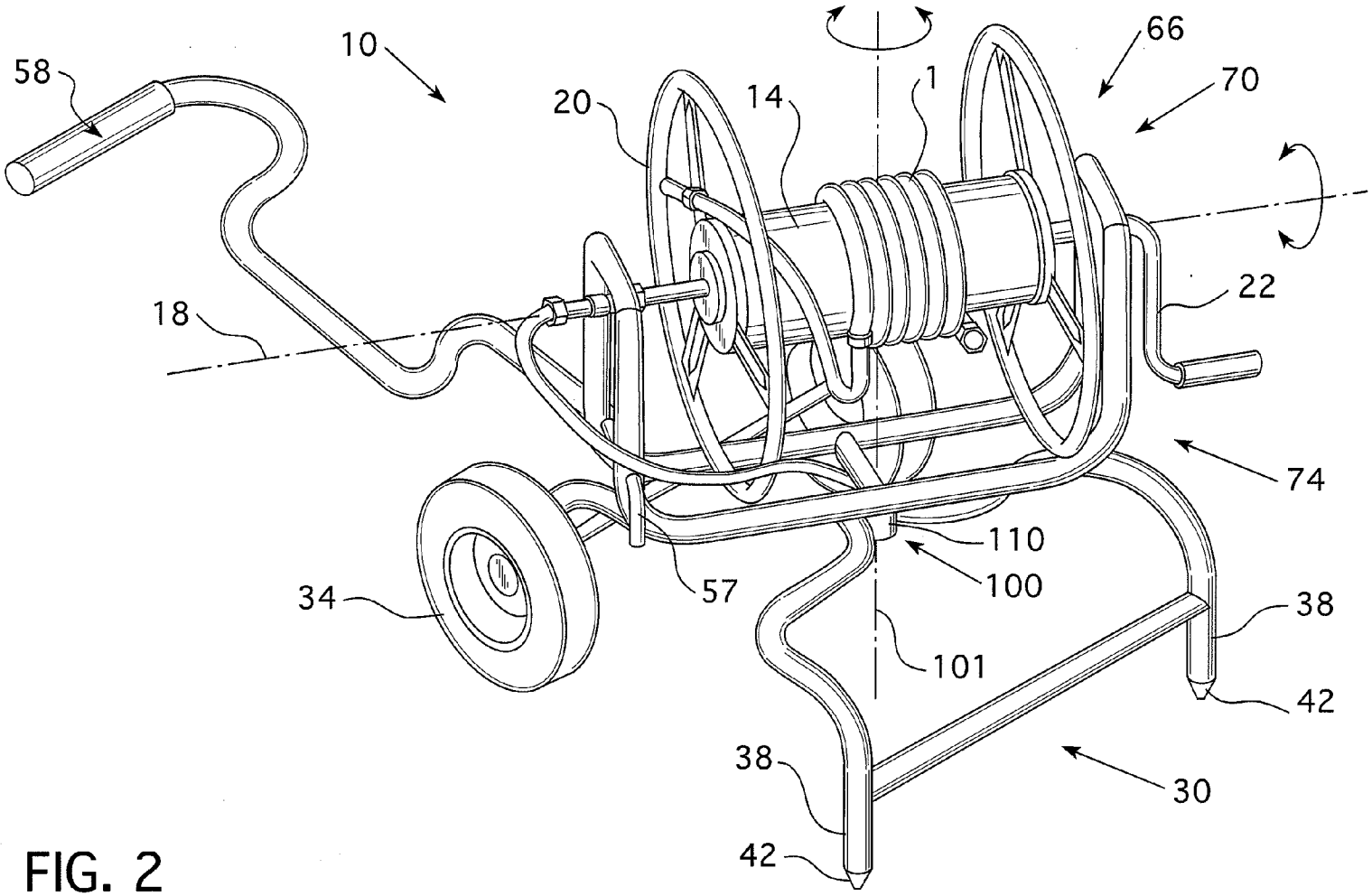
FIG. 2 is an isometric view of a hose wagon with the handle in the second position and the hose reel frame assembly rotated about a vertical axis.
Figure 3:
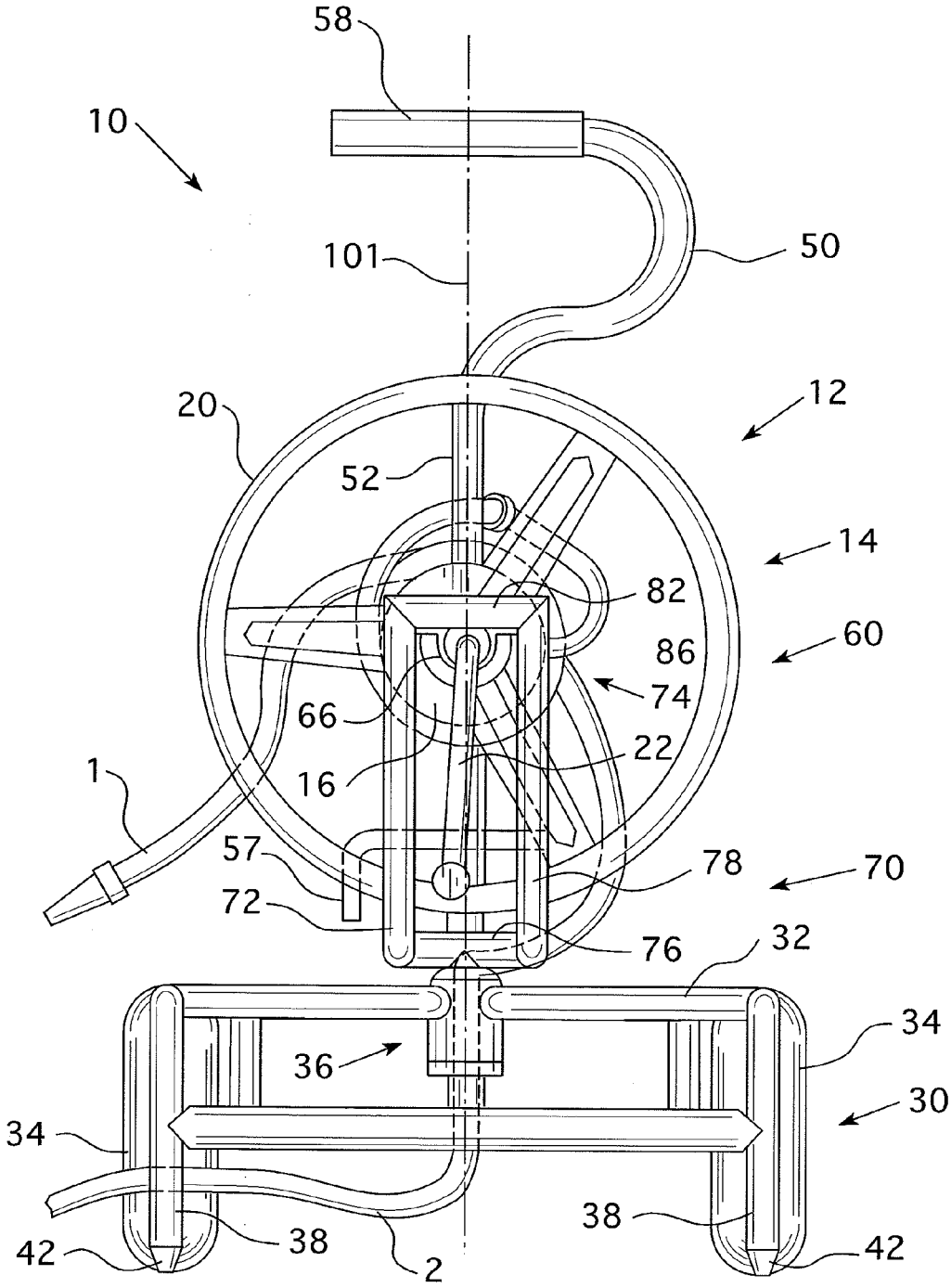
FIG. 3 is a front end view of a hose wagon.
Figure 4:
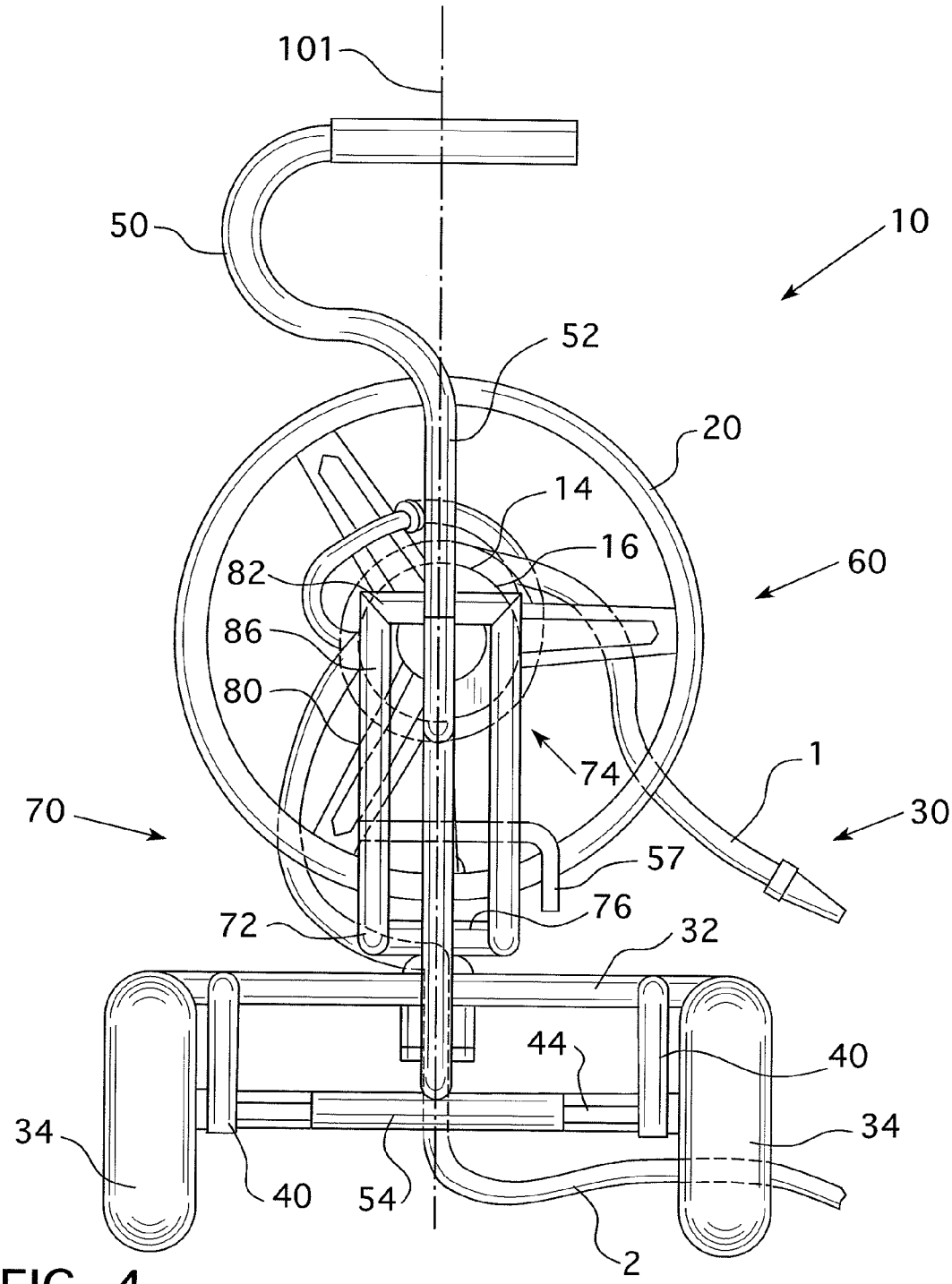
FIG. 4 is a back end view of a hose wagon.
Figure 5:
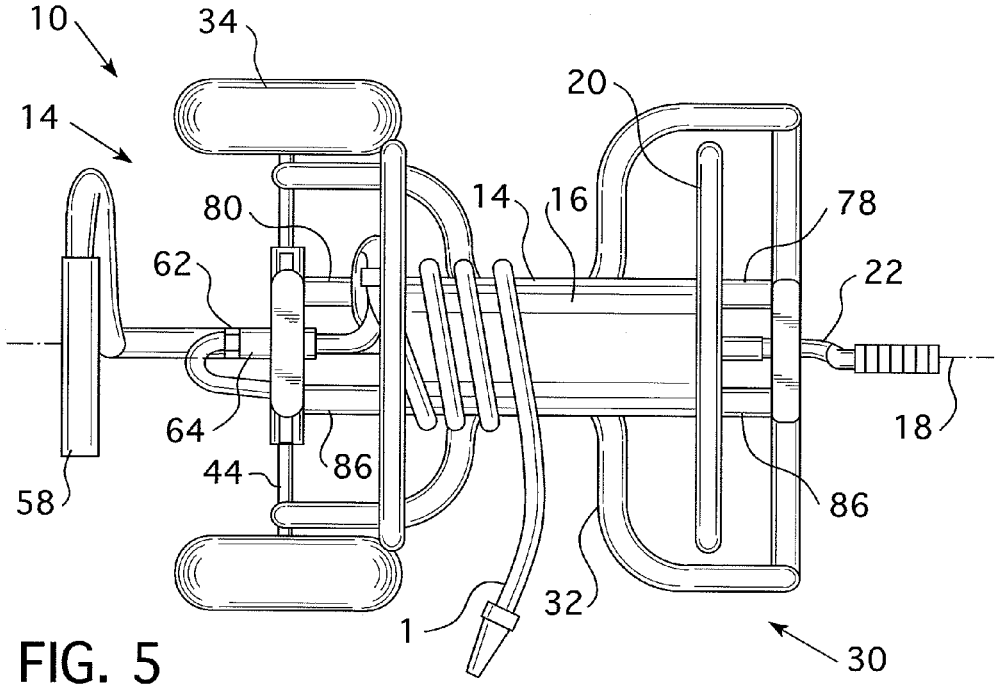
FIG. 5 is a top view of a hose wagon.
Figure 6:
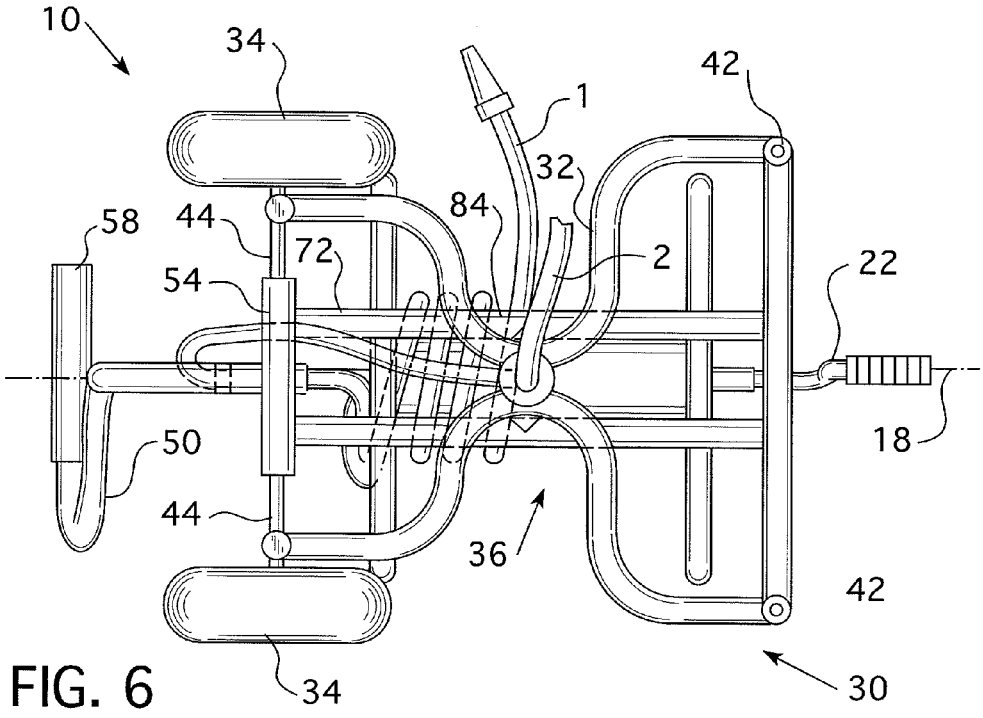
FIG. 6 is a bottom view of a hose wagon.
Figure 7:
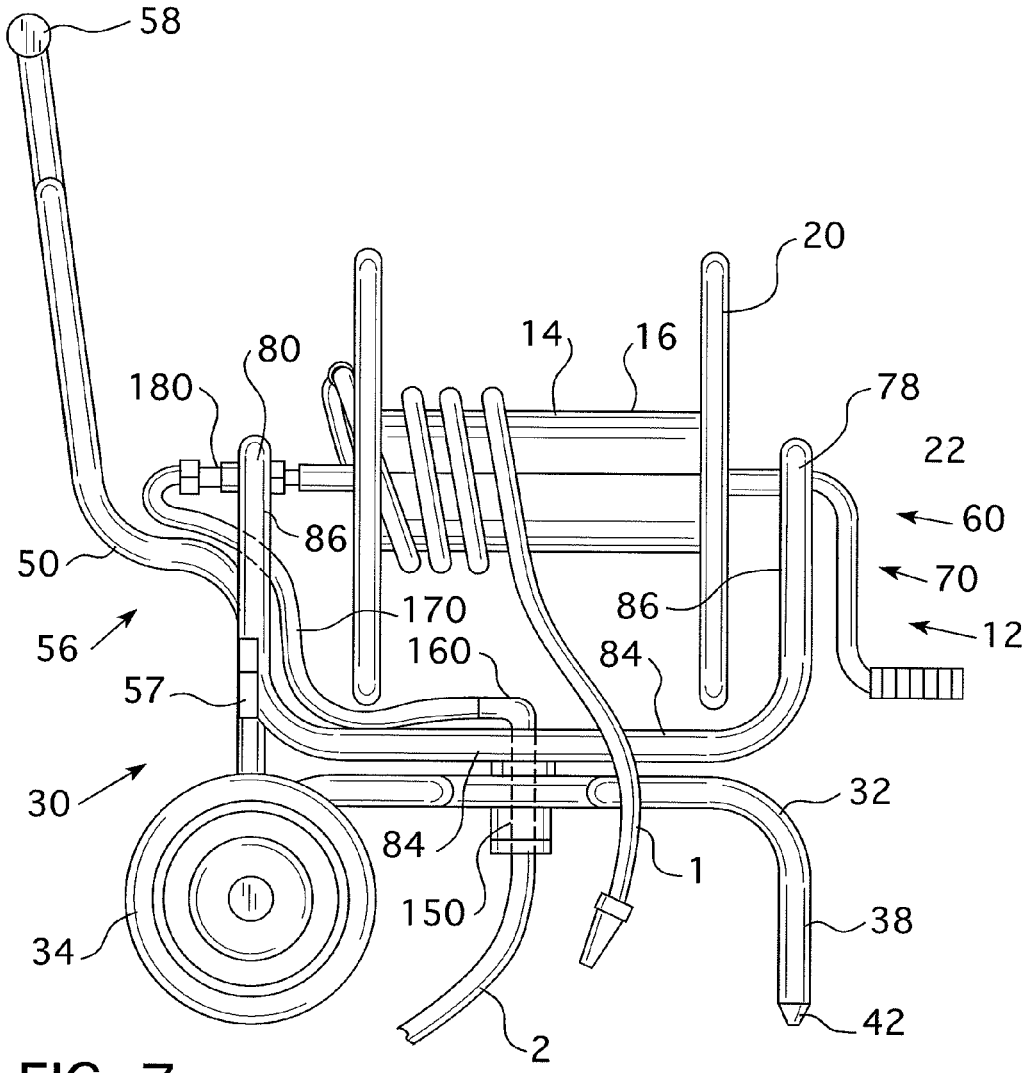
FIG. 7 is a side view of a hose wagon.

As used herein, "structured to rotate freely about" means that one element (or assembly) is rotatably coupled to another element (or assembly) and may move through 360 degrees without the elements, or any other elements structured to be coupled to/supported by either rotatably coupled elements, coming into contact with each other or without flexible elements twisting/binding. That is, an element "structured to rotate freely about" another element may be rotated, essentially, continuously in one direction about the axis of rotation without the need to reverse the direction of rotation due to interference or binding components.

As used herein, directional phrases are relative to the orientation of the hose wagon as shown in the figures and are not limiting in the claims.

As used herein, "coupled" means a link between two or more elements, whether direct or indirect, so long as a link occurs.

As used herein, "directly coupled" means that two elements are directly in contact with each other.

As used herein, "fixedly coupled" or "fixed" means that two components are coupled so as to move as one while maintaining a constant orientation relative to each other.

As used herein, the word "unitary" means a component is created as a single piece or unit. That is, a component that includes pieces that are created separately and then coupled together as a unit is not a "unitary" component or body.

As shown in FIGS. 1-7, a hose wagon 10 includes a frame assembly 12 structured to rotatably support a hose reel 14.

The hose reel 14 is an elongated, generally cylindrical body 16 having a longitudinal axis 18. The hose reel 14 preferably includes hubs 20, which have a greater diameter than the hose reel 14, disposed at each end of the hose reel body 16. The frame assembly 12 is structured to rotatably support the hose reel 14 with the hose reel longitudinal axis 18 extending in a generally horizontal plane. A handle 22 is coupled to the hose reel 14 and structured to allow a user to rotate the hose reel 14 about the horizontal axis 18. The hose reel 14 is structured to support a use hose 1. That is, the use hose 1 is coiled about the hose reel 14 for storage, transport, etc., and may be uncoiled for use. Thus, the frame assembly 12 is structured to allow the hose reel 14 to rotate freely about the generally horizontal axis. Further, as detailed below, the frame assembly 12 is structured to allow the hose reel 14 to rotate freely about a vertical axis as well. Also, as detailed below, the hose wagon 10 is structured to receive water from a supply hose 2. The supply hose 2 is coupled to, and in fluid communication with, the use hose 1, via the water supply assembly 90 discussed below.

The frame assembly 12 includes a wagon frame assembly 30 and a hose reel frame assembly 70. The wagon frame assembly 30, preferably, includes a plurality of tubular frame members 32, but may include members of other shapes including, but not limited to, planar members (not shown). The wagon frame assembly 30 further includes at least one, and preferably two, wheels 34. The wagon frame assembly frame members 32 preferably define an "X" shape wherein there is a medial location 36. As discussed below, a swivel base assembly 100 created by elements on the wagon frame assembly 30 and the hose reel frame assembly 70, is disposed at the medial location 36. The frame members 32 defining the "X" shape are mostly disposed in a generally horizontal plane, however, the forward ends 38 and the rearward ends 40 of the wagon frame assembly frame members 32 extend downwardly. The frame member forward ends 38 are, preferably, caped by rounded spikes 42. The frame member rearward ends 40, preferably, define, or include, a bracket for an axle 44. The axle 44 is coupled to the frame member rearward ends 40 and extends laterally relative to the hose wagon 10 in a generally horizontal plane. The wheels 34 are disposed on each end of the axle 44. As is known, the axle 44 may be rotatably coupled to the wagon frame assembly 30 and/or the wheels 34 may be rotatably coupled to the axle 44.

The wagon frame assembly 30 further includes a movable handle 50. The handle 50 includes a vertical portion 52 and a lower horizontal portion 54. The handle horizontal portion 54 is structured to be disposed between the frame member rearward ends 40 and, preferably, is structured to be disposed about the axle 44. That is, the axle 44 is rotatably disposed and extends through the handle horizontal portion 54. Alternately, it may be said that the handle 50 is pivotally coupled to the axle 44. The handle vertical portion 52 includes an offset 56 which is a medial bend. The offset 56 allows for the handle 50 to be coupled to the hose reel frame assembly yoke 74, as discussed below. The upper end of the handle vertical portion 52 may include a grip 58 which, preferably, extends generally horizontally. As the handle is pivotally coupled to the axle 44, the handle 50 is structured to be moved between an upper, first position (FIG. 1), wherein the handle 50 is disposed on the upper side of the hose wagon 10, and a second position (FIG. 2), wherein the handle 50 is disposed at a location lower than the cup 110, as discussed below.

Figure 8:
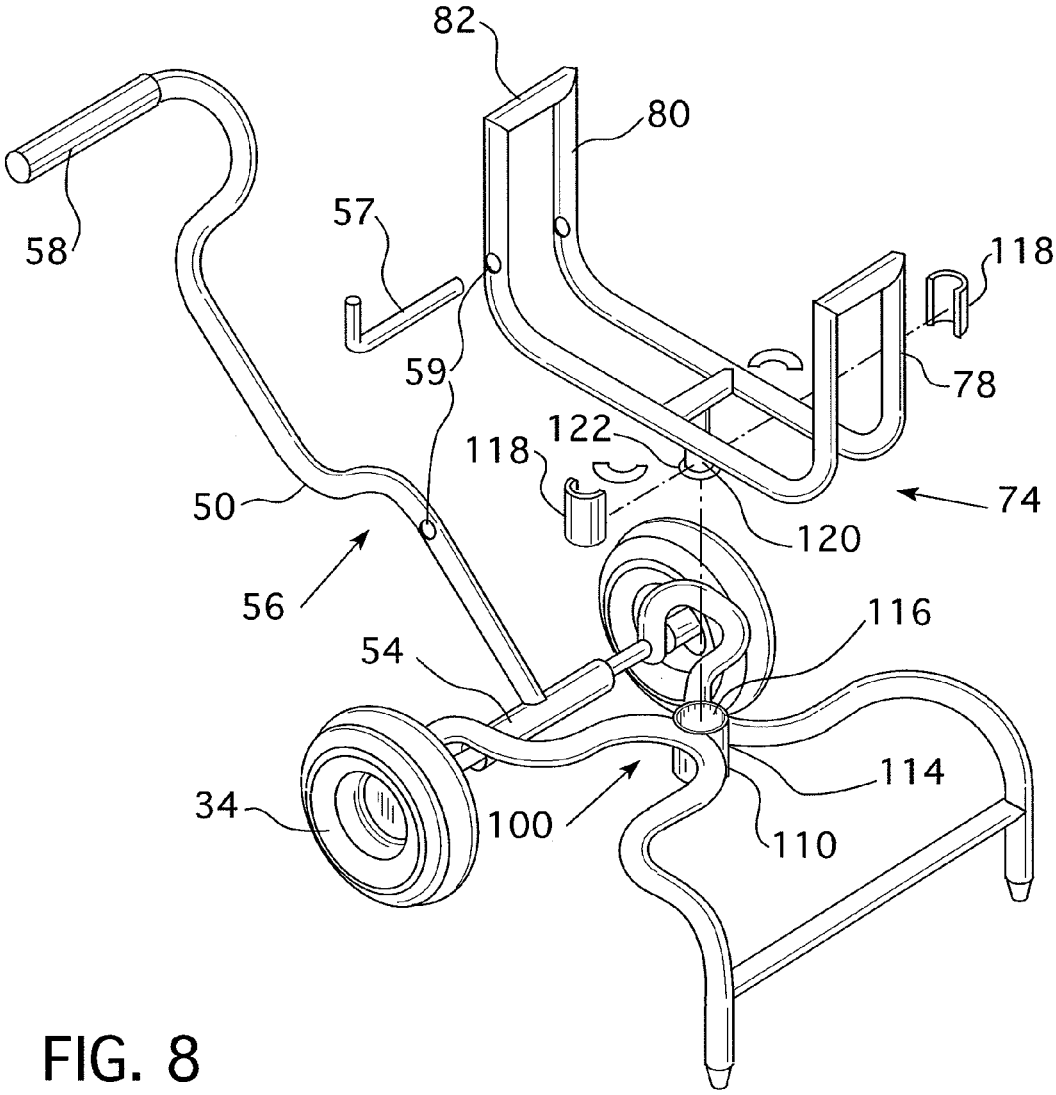
FIG. 8 is an exploded partial isometric view of a hose wagon with selected elements removed for clarity.
Figure 9:
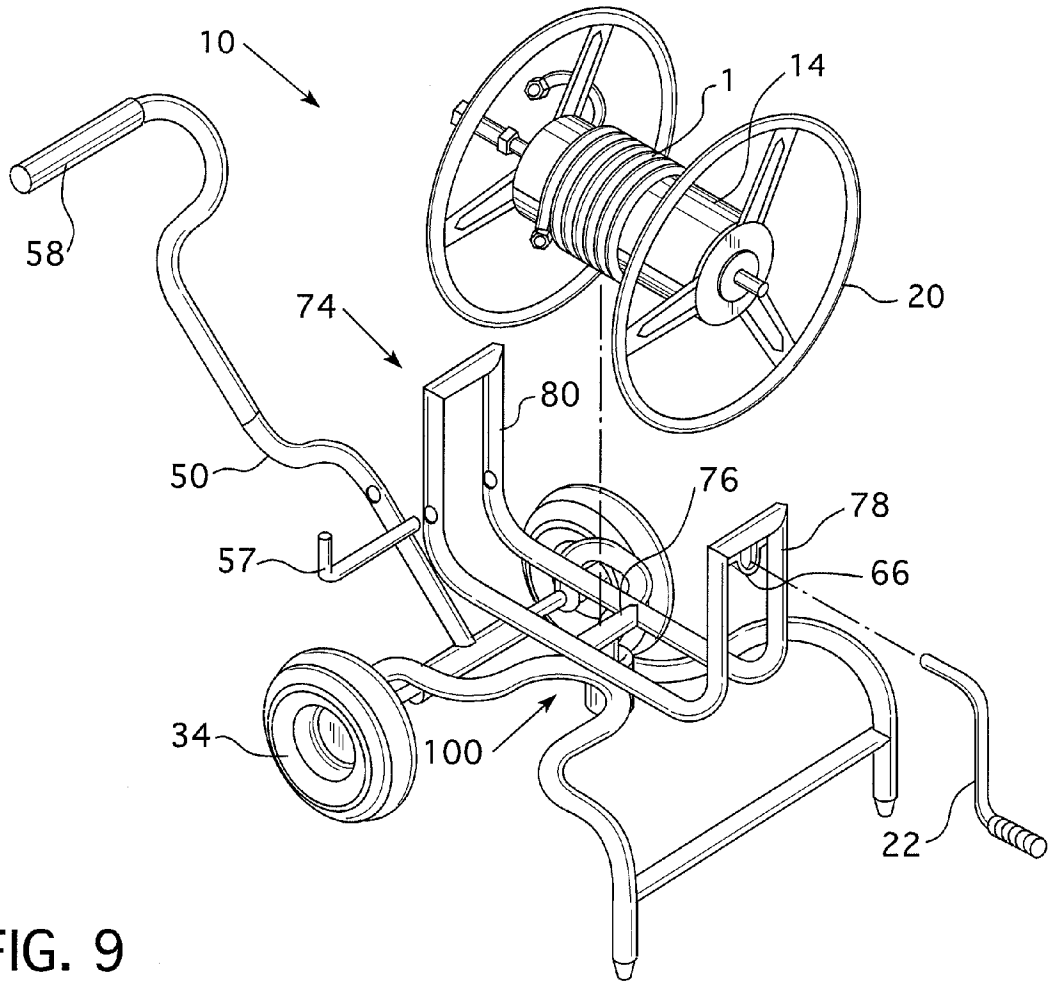
FIG. 9 is an exploded partial isometric view of a hose wagon with selected elements removed for clarity.

Generally, the handle 50 is placed in the upper position when the hose wagon 10 is being moved or stored, and placed in the lower position when the use hose 1 is being used. In this configuration, the handle is not disposed in the path of travel of the use hose 1 when the use hose 1 is in use. As shown in FIGS. 8 and 9, the frame assembly 12 may include a pin 57 structured to extend through openings 59 in the yoke 74 (described below) and the handle 50. When the pin 57 is positioned through the yoke 74 and the handle 50, the yoke 74 and the handle 50 are coupled. In this configuration, the yoke 74 cannot rotate about the vertical axis 101 and the handle 50 cannot move to the second position.

Figure 10:
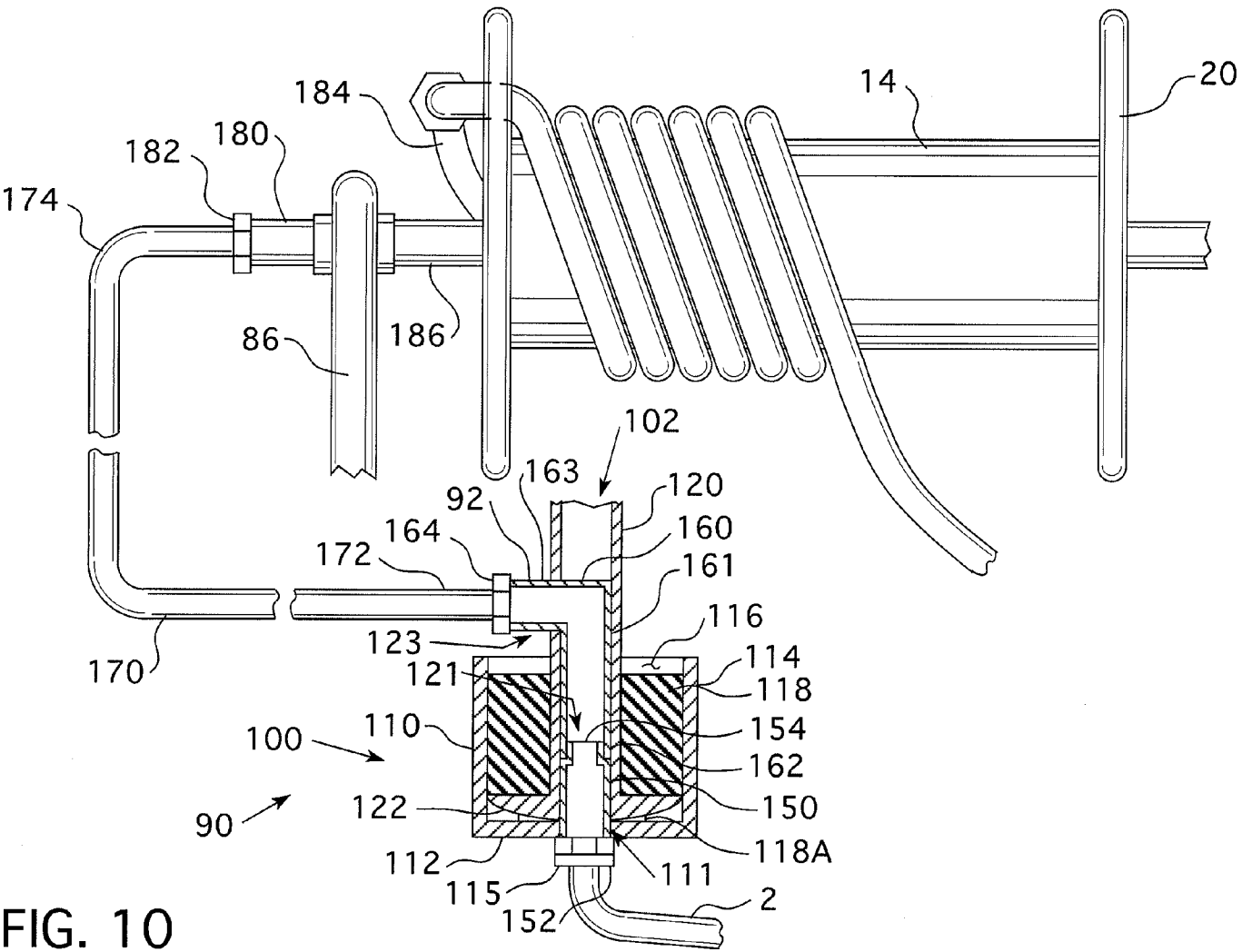
FIG. 10 is a schematic view of the water supply assembly.

The hose wagon 10 also includes a hose reel assembly 60 that includes a water supply assembly 90 (shown schematically in FIG. 10) as well as the previously identified hose reel 14 and hose reel frame assembly 70. The hose reel 14 preferably includes an axle 62 that extends along the hose reel longitudinal axis 18. The hose reel axle 62 is a tubular member 64 that extends from both sides of the hose reel body 16. Preferably, one end of the hose reel axle 62 is at least partially hollow and is structured to allow a water conduit member 92, discussed below, to pass therethrough.

Preferably, the hose reel frame assembly 70 also includes a plurality of tubular members 72. The hose reel frame assembly tubular members 72 define a yoke 74 structured to rotatably support the hose reel 14. That is, the hose reel frame assembly tubular members 72 that form the yoke 74 include a medial base member 76, a first arm 78 and a second arm 80. Preferably, the first arm 78 and the second arm 80 are defined by spaced hose reel frame assembly tubular members 72 coupled by a cross-member 82 at the distal tips, however, as the yoke 74 may be formed from a singular hose reel frame assembly tubular member 72 extending in opposite directions, the following description shall refer to the first arm 78 and the second arm 80 as singular elements.

The first arm 78 and the second arm 80 each have a base end 84 and a hose reel end 86. Both of the first arm and said second arm base ends 84 are coupled to the yoke base member 76. It is noted that in the embodiment shown, i.e. having spaced hose reel frame assembly tubular members 72, the yoke base member 76 extends, generally perpendicularly, between the spaced hose reel frame assembly tubular members 72. In an embodiment having single hose reel frame assembly tubular members 72 forming the yoke 74, the first arm and said second arm base ends 84 may be contiguous, generally horizontal portions (not shown). The first arm and second arm hose reel ends 86 are structured to be rotatably coupled to the hose reel axle 62. In the embodiment shown, the coupling is a U-shaped bracket 66 disposed on the yoke cross-member 82. In an embodiment having single hose reel frame assembly tubular members 72 forming the yoke 74, the first arm and said second arm hose reel ends 86 may include a circular opening or similar coupling (not shown) to support the hose reel axle 62. Thus, in this configuration, the first arm and said second arm base ends 84 are adjacent to each other and the first arm and said second arm hose reel ends 86 are spaced from each other, thus the first arm 78 and the second arm 80 define the yoke 74.

In this configuration, the hose reel 14 may be rotatably coupled to the hose reel frame assembly 70 and, more specifically, to the yoke 74. That is, the hose reel axle 62 extends, generally horizontally, between the yoke's first arm and second arm hose reel ends 86. Thus, the hose reel 14 is structured to rotate about a generally horizontal axis.

As noted above, and as shown in FIGS. 7-9, a swivel base assembly 100 is created by elements on the wagon frame assembly 30 and the hose reel frame assembly 70. More specifically, the swivel base assembly 100 includes a cup 110, which is part of the wagon frame assembly 30, and a generally vertical support stem 120, which is part of the hose reel frame assembly 70. The cup 110 is preferably a generally cylindrical body. The cup 110 includes a bottom member 112, which is preferably planar, and an ascending sidewall 114. Thus, the cup 110 defines a generally enclosed space 116. The vertical support stem 120 extends downwardly from the yoke base member 76. The vertical support stem 120 is sized to fit within the cup enclosed space 116. The vertical support stem 120 preferably has a convex lower surface 122. Generally, the vertical support stem 120 is disposed in the cup 110 with the convex lower surface 122 engaging the cup bottom member 112. The cup 110 may further include friction reducing elements such as a bearing 118 disposed between the cup sidewall 114 and the vertical support stem 120 as well as a lubricant 118A disposed between the convex lower surface 122 and the cup bottom member 112. Thus, the swivel base assembly 100 defines a generally vertical axis 101 about which the hose reel frame assembly 70, and therefore the hose reel 14 may rotate.

As detailed below, the cup 110 and the vertical support stem 120 may define a passage 102 for the water supply assembly 90. That is, in one embodiment the cup 110 includes a central opening 111 on the cup bottom member 112. The vertical support stem 120 is hollow and also has a central, lower opening 121 on the lower surface 122 and a radial opening 123, preferably at a location above the top of the cup 110. As described below, water supply assembly conduit members 92 may pass through the cup 110 and the vertical support stem 120, entering and exiting the swivel base assembly 100 via the openings set forth above.

Figure 11:
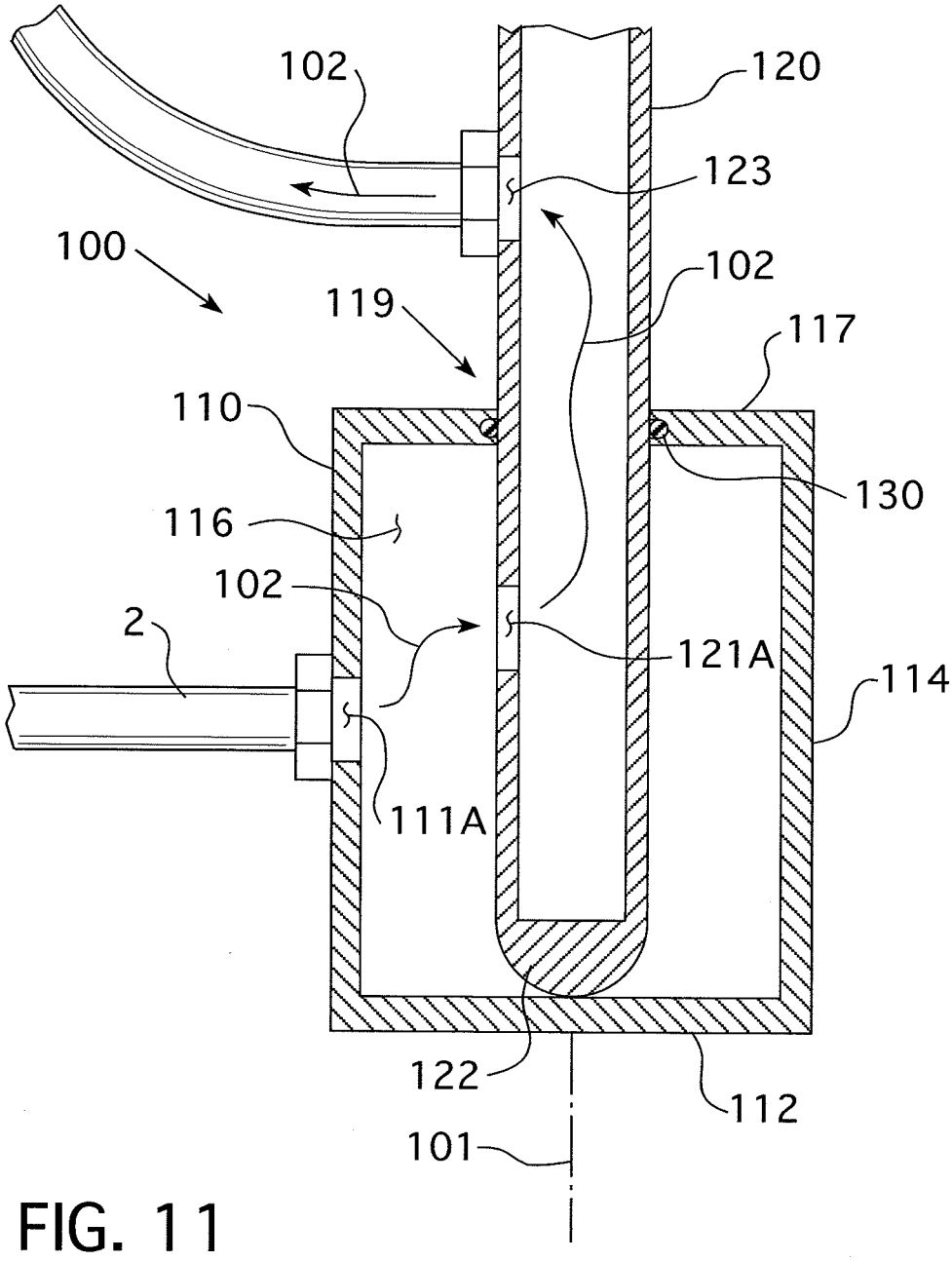
FIG. 11 is a schematic view of an alternate swivel base.

Alternatively, as shown in FIG. 11, and as described below, swivel base assembly 100 may act as the passage 102 for the water supply assembly 90. In this embodiment, the cup 110 includes a lower opening 111A on either the cup bottom member 112 (not shown) or the cup sidewall 114 (shown) and a top member 117 having a central opening 119. The cup lower opening 111A preferably includes a coupling 115, such as, but not limited to, a standard threaded hose coupling, structured to be coupled to, and in fluid communication with, the supply hose 2. The cup 110 elements, i.e. the bottom member 112, sidewall 114, and top member 117 form a sealed, enclosed space 116. This embodiment of the cup 110 may be formed as an unitary body, or may have one or more elements coupled together. If the cup elements are coupled together, seals (not shown), such as, but not limited to, rubber O-rings may be disposed between the element interfaces so as to create the sealed, enclosed space 116. The cup top member opening 119 is sized to allow the vertical support stem 120 to pass therethrough. A seal 130 is disposed between the vertical support stem 120 and the cup top member opening 119. The vertical support stem 120 is hollow and includes a lower opening 121A located on the portion of the vertical support stem 120 disposed inside the sealed, enclosed space 116, and, a radial opening 123, located above the cup top member 117. The vertical support stem radial opening 123 preferably includes a coupling 115, such as, but not limited to, a standard threaded hose coupling, structured to be coupled to, and in fluid communication with, a water supply assembly conduit member 92.

It is noted that, when the handle 50 is in the lower, second position, there are no elements of the wagon frame assembly 30 that extend above the cup 110. As such, there are no structural elements of the hose wagon 10 that impede the free rotation of the hose reel 14 about either the vertical axis or the horizontal axis identified above. However, to provide for free rotation, as defined above, the elements coupled to/supported by the hose wagon 10 must also not prevent the rotation of the hose reel 14. That is, the use hose 1 and the supply hose 2 cannot impede the free rotation of the hose reel 14 about either the vertical axis or the horizontal axis either by being disposed in the path of travel of the hose wagon 10 or by binding/twisting when the hose reel 14 is rotated.

Thus, the free rotation of the hose reel 14 also relies upon the structure of the water supply assembly 90. The water supply assembly 90, preferably, includes a plurality of conduit members 92. Generally, each conduit member 92 has an upstream end and a downstream end. When directly coupled conduit members 92 are not required to rotate relative to each other, the conduit members 92 may included threaded ends, or other known coupling devices, that fix the conduit members 92 together and provide for fluid communication between the conduit members 92. When the conduit members 92 are required to rotate relative to each other, the conduit members 92 are, preferably, rigid and have the downstream end of the upstream conduit disposed within the upstream end of the downstream conduit. Further, as is known, one or more seals may be disposed between the directly coupled conduits to resist leakage. Hereinafter, the seals will not be specifically identified, but it is understood that such seals exist at each rotational coupling, and may exist at non-rotating couplings.

In the preferred embodiment, the conduit members 92 include an inlet conduit 150 and an outlet conduit 160. The water supply assembly inlet conduit 150 has an inlet end 152 and an outlet end 154. The water supply assembly outlet conduit 160 has an inlet end 162 and an outlet end 164. The water supply assembly inlet conduit inlet end 152 is structured to be coupled to, and in fluid communication with, the supply hose 2. The water supply assembly inlet conduit outlet end 154 is structured to be rotatably coupled to, and in fluid communication with, the water supply assembly outlet conduit inlet end 162. Further, the water supply assembly outlet conduit inlet end 162 is structured to be coupled to, and in fluid communication with, the water supply assembly inlet conduit outlet end 154. The water supply assembly outlet conduit outlet end 164 is structured to be coupled to, and in fluid communication with, the use hose. It is noted that a single outlet conduit 160 may extend from the swivel base assembly 100 and pass through the hose reel axle 62, typically following a path adjacent to a yoke arm, e.g. first arm 78 (not shown). However, for ease of assembly and manufacture, it is preferable that the conduit members 92 include the following additional conduit members 92: a flexible intermediate conduit 170 and a hose reel conduit 180. Each of the flexible intermediate conduit 170 and the hose reel conduit 180 have an inlet end 172, 182 and an outlet end 174, 184, respectively. The hose reel conduit 180 has a straight portion 186 that extends through, or may form a part of, the hose reel axle 62. Thus, the hose reel conduit 180 extends along the axis of the hose reel 14.

The preferred embodiment of the water supply assembly 90 is assembled as follows. The inlet conduit 150 is disposed along the swivel base assembly 100 vertical axis, extending through the cup bottom member central opening 111 and into the hollow vertical support stem 120 via the vertical support stem lower opening 121. The inlet conduit inlet end 152 is disposed below, and outside, of the cup 110. The inlet conduit outlet end 154 is disposed within the vertical support stem 120. The outlet conduit 160 includes a generally perpendicular bend and therefore has a vertical portion 161 at the outlet conduit inlet end 162, and a horizontal portion 163 at the outlet conduit outlet end 164. The outlet conduit inlet end 162, that is the outlet conduit vertical portion 161 is disposed within the hollow vertical support stem 120. The outlet conduit inlet end 162 is rotatably coupled to, and in fluid communication with, the inlet conduit outlet end 154. The outlet conduit outlet end 164 is disposed above the top of the cup 110.

The intermediate conduit inlet end 172 is coupled to, and in fluid communication with, the outlet conduit outlet end 164. The hose reel conduit 180 extends through, or may form a part of, the hose reel axle 62. The intermediate conduit outlet end 174 and the hose reel conduit inlet end 182 are rotatably coupled and in fluid communication. The hose reel conduit outlet end 184 is disposed adjacent to the hose reel 14 and may be coupled to, and in fluid communication with, the use hose 1.

Thus, the water supply assembly 90 includes two rotatable couplings, i.e. the outlet conduit inlet end 162/inlet conduit outlet end 154 and the intermediate conduit outlet end 174/hose reel conduit inlet end 182, disposed, respectively, upon the vertical axis of rotation and the horizontal axis of rotation for the frame assembly 12. By having the water supply assembly 90 rotatable couplings at these locations, the elements of the water supply assembly 90 will not become twisted or otherwise bound as the hose reel 14 rotates about either the vertical axis of rotation and/or the horizontal axis of rotation of the frame assembly 12. Further, because the use hose is uncoiled in a generally horizontal direction and because there are no elements of the wagon frame assembly 30 that extend above the cup 110 when the handle 50 is in the lower, second position, there are no elements of the wagon frame assembly 30 that will interfere with the use hose 1 as the hose reel frame assembly 70 rotates about the vertical axis 101 of the swivel base assembly 100. Thus, in this configuration, the hose reel 14 is rotatably coupled to the frame assembly 12 and structured to rotate freely about a generally vertical axis 101 and a generally horizontal axis 18.

As noted above, in an alternate embodiment (FIG. 11), the swivel base assembly 100 may act as the passage 102 for the water supply assembly 90. In this embodiment, the supply hose is coupled to, and in fluid communication with, the coupling 115 at the cup lower opening 111A. Thus, the supply hose 2 is structured to fill the sealed, enclosed space 116. Further, water in the sealed, enclosed space 116 passes through the vertical support stem lower opening 121A, through the hollow vertical support stem 120 and exits via the a radial opening 123. As discussed above, an intermediate conduit 170 and a hose reel conduit 180 are used to extend the water supply assembly 90 to a location adjacent the hose reel 14. That is, an intermediate conduit 170 may be coupled to, and in fluid communication with, the coupling 115 at the vertical support stem radial opening 123 and be further coupled to, and in fluid communication with, the hose reel conduit 180. Thus, the swivel base assembly 100 defines a passage 102 for the water supply assembly 90.

It is further noted that, just as the structure of the swivel base assembly 100 may be used as part of the water supply assembly 90, the elements of the hose reel frame assembly 70 may also define the water supply assembly 90. That is, in an embodiment not shown, instead of having a vertical support stem radial opening 123 and an intermediate conduit 170, all, or selected, hose reel frame assembly tubular members 72 as well as the hose reel axle 62 may be hollow and define a passage from the vertical support stem 120 to a location adjacent the hose reel 14. It is noted that at least one rotatable coupling would be disposed at the interface of the hose reel axle 62 and the hose reel frame assembly 70. Such a rotatable coupling would include seals to resist water leakage. Further, the hose reel 14 may define a hollow tubular member having a radial hose coupling. Thus, water could be introduced by the supply hose 2 into the swivel base assembly 100. The water could then travel through the hose reel frame assembly tubular members 72 and hose reel axle 62 into the hollow hose reel 14. The use hose 1 could then be coupled directly to the hollow tubular hose reel.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A hose wagon, said hose wagon structured to receive water from a supply hose and to support a use hose, said hose wagon comprising:

a frame assembly structured to rotatably support a hose reel;

said frame assembly includes a wagon frame assembly and a hose reel frame assembly;

said hose reel frame assembly includes a yoke;

said yoke including a medial base member;

said yoke medial base having a generally vertical support stem that extends generally downwardly;

said wagon frame assembly having a cup, wherein said cup includes a bottom member and an ascending sidewall disposed in a fixed relationship; and said wagon frame assembly cup and said hose reel frame assembly vertical support stem creating said swivel base assembly;

an elongated, generally cylindrical hose reel; and wherein when said hose reel is rotatably coupled to said frame assembly, said hose reel is structured to rotate freely about a generally vertical axis and a generally horizontal axis.

2. The hose wagon of claim 1 wherein:

said vertical support stem includes a convex lower surface;

said wagon frame assembly cup includes a generally planar bottom member; and said vertical support stem convex lower surface structured to engage said wagon frame assembly cup bottom member.

3. The hose wagon of claim 2 wherein:

a hose reel assembly having a water supply assembly, said hose reel, and said hose reel frame assembly;

said water supply assembly structured to be coupled to, and in fluid communication with, both said supply hose and said use hose;

said hose reel structured to have said use hose coiled thereabout;

said hose reel frame assembly structured to rotatably support said hose reel in a generally horizontal plane; and said hose reel frame assembly rotatably coupled to said wagon frame assembly and structured to rotate freely about a generally vertical axis while supporting said use hose.

4. The hose wagon of claim 2 wherein:

said wagon frame assembly cup has friction reducing elements including a lubricant and a bearing assembly;

said bearing assembly having a bearing disposed between said wagon frame assembly cup sidewall and said vertical support stem; and said lubricant disposed between said support stem convex lower surface and said wagon frame assembly cup bottom member.

5. The hose wagon of claim 1 wherein:

said wagon frame assembly includes a plurality of frame members and a handle;

said cup disposed on said frame members;

said handle pivotally coupled to one said frame member, said handle structured to move between an upper, first position, wherein said handle is disposed on the upper side of the hose wagon, and a second position, wherein said handle is disposed at a location lower than said cup;

whereby, when said handle is in said second position and when said use hose is uncoiled from said hose reel, said hose reel may be rotated about a vertical axis through an entire circle without said handle interfering with the rotation of said hose reel about said vertical axis.

6. The hose wagon of claim 3 wherein said wagon frame assembly and said hose reel frame assembly are rotatably coupled by a swivel base assembly having a generally vertical axis of rotation.

7. The hose wagon of claim 6 wherein said water supply assembly includes a passage through said swivel base assembly.

8. The hose wagon of claim 7 wherein:

said water supply assembly includes a plurality of conduit members; and at least one water supply assembly conduit member extending through said swivel base assembly.

9. The hose wagon of claim 8 wherein:

said plurality of water supply assembly conduit members includes an inlet conduit and an outlet conduit;

said water supply assembly inlet conduit having an inlet end and an outlet end, said water supply assembly inlet conduit inlet end structured to be coupled to, and in fluid communication with, said supply hose, said water supply assembly inlet conduit outlet end structured to be rotatably coupled to, and in fluid communication with, said water supply assembly outlet conduit;

said water supply assembly outlet conduit having an inlet end and an outlet end, said water supply assembly outlet conduit inlet end structured to be rotatably coupled to, and in fluid communication with, said water supply assembly inlet conduit, said water supply assembly outlet conduit outlet end structured to be coupled to, and in fluid communication with, said use hose; and said inlet conduit and said outlet conduit being rotatably coupled.

10. The hose wagon of claim 9 wherein said inlet conduit and said outlet conduit are rotatably coupled about a generally vertical axis of rotation.

11. The hose wagon of claim 10 wherein:

said plurality of water supply assembly conduit members further includes a hose reel conduit, said hose reel conduit having an inlet end and an outlet end, said hose reel conduit inlet end structured to be coupled to, and in fluid communication with, said water supply assembly outlet conduit outlet end, said hose reel conduit outlet end structured to be coupled to, and in fluid communication with, said use hose; and said hose reel conduit disposed along the rotational axis of said hose reel.

12. The hose wagon of claim 11 wherein:

said hose reel includes an axle, said axle extending along said hose reel axis; and said hose reel conduit extending through at least a portion of said axle.

13. The hose wagon of claim 12 wherein:

said hose reel frame assembly yoke structured to rotatably support said hose reel, said yoke including a first arm and a second arm;

said first arm and said second arm each having a base end and a hose reel end, said first arm and said second arm base end being coupled to said yoke base member, said first arm and said second arm hose reel end each being spaced from each other and structured to be rotatably coupled to said hose reel axle.

14. The hose wagon of claim 13 wherein:

said wagon frame assembly cup includes a generally planar bottom member and an upwardly extending sidewall; and said inlet conduit extends through said vertical support stem.

15. The hose wagon of claim 7 wherein:

said swivel base assembly includes a cup that is part of said wagon frame assembly and a vertical support stem that is part of said hose reel frame assembly;

said vertical support stem being at least partially hollow and having a top end, a bottom end, and a lateral opening extending said vertical support stem hollow portion, the top of said vertical support stem defining a coupling that is in fluid communication with said vertical support stem hollow portion;

said cup having a generally planar bottom member, an upwardly extending sidewall, and a top member, said cup defining an enclosed space;

said vertical support stem passing through said cup top member and rotatably disposed in said cup, the top end of vertical support stem extending upwardly from said cup;

a seal disposed between said vertical support stem and said cup top member, whereby said cup is substantially watertight;

said cup side wall having an inlet structured to be coupled to said supply hose;

said water supply assembly includes an outlet conduit having an inlet end and an outlet end, said water supply assembly outlet conduit inlet end structured to be coupled to, and in fluid communication with, said vertical support stem top end coupling, said water supply assembly outlet conduit outlet end structured to be coupled to, and in fluid communication with, said use hose; and whereby water supplied via said supply hose fills said cup and thereafter passes through said water supply assembly outlet conduit to said use hose.

16. The hose wagon of claim 15 wherein:

said water supply assembly further includes a hose reel conduit, said hose reel conduit having an inlet end and an outlet end, said hose reel conduit inlet end structured to be coupled to, and in fluid communication with, said water supply assembly outlet conduit outlet end, said hose reel conduit outlet end structured to be coupled to, and in fluid communication with, said use hose; and said hose reel conduit disposed along the rotational axis of said hose reel.

17. The hose wagon of claim 16 wherein:

said hose reel includes an axle, said axle extending along said hose reel axis; and said hose reel conduit extending through at least a portion of said axle.

18. The hose wagon of claim 17 wherein:

said vertical support stem includes a convex lower surface;

said vertical support stem convex lower surface structured to engage said wagon frame assembly cup bottom member.

19. The hose wagon of claim 18 wherein:

said hose reel frame assembly includes a yoke, said hose reel frame assembly yoke structured to rotatably support said hose reel, said yoke including a medial base member, a first arm and a second arm;

said first arm and said second arm each having a base end and a hose reel end, said first arm and said second arm base end being coupled to said yoke base, said first arm and said second arm hose reel end each being spaced from each other and structured to be rotatably coupled to said hose reel axle; and said yoke medial base including said generally vertical support stem.

* * * * *